United States Patent [19]

Olsson et al.

[11] Patent Number: 4,626,637

[45] Date of Patent: Dec. 2, 1986

[54] CONTACT ASSEMBLY

[75] Inventors: Billy E. Olsson, New Cumberland; David W. Rupnik, Mechanicsburg, both of Pa.

[73] Assignee: AMP Incorporated, Harrisburg, Pa.

[21] Appl. No.: 744,350

[22] Filed: Jun. 13, 1985

Related U.S. Application Data

[63] Continuation of Ser. No. 535,505, Sep. 26, 1983.

[51] Int. Cl.[4] ..... H01H 1/40

[52] U.S. Cl. ..... 200/284; 200/11 G; 200/155 R

[58] Field of Search ..... 29/622; 188/266, 306; 200/284, 11 R, 11 A, 11 G, 155 A, 155 R

[56] References Cited

U.S. PATENT DOCUMENTS

| | | | |
|---|---|---|---|
| 3,196,221 | 7/1965 | Braunagle | 200/11 A |
| 3,210,829 | 10/1965 | Lipps | 200/11 R |
| 3,391,259 | 7/1968 | Massengale | 200/11 R |
| 3,538,602 | 10/1970 | Bang | 29/622 |
| 3,736,390 | 5/1973 | Lockard | 200/284 |
| 3,939,313 | 2/1976 | Hayashi et al. | 200/61.89 |
| 4,016,387 | 4/1977 | Aberer | 200/284 |
| 4,352,964 | 10/1982 | English | 29/622 |

*Primary Examiner*—Stephen Marcus
*Assistant Examiner*—Renee S. Luebke
*Attorney, Agent, or Firm*—Robert W. J. Usher; Anton P. Ness

[57] ABSTRACT

A contact assembly for a rotary switching unit incorporated in a vehicle suspension unit in which a pair of stamped and formed metal terminals are moulded in a plastics stator block of a stator with contact portions precisely flush with a contact face of the block and wire-connecting portions with wire-receiving slots protruding radially from the side of the block in alignment with wire-confining grooves formed in the block periphery. A rotor comprises a plastics disc heat staked to a support plate and carrying a brush arranged to wipe around the contact face of the block and make electrical contact with the flush contact portions.

18 Claims, 5 Drawing Figures

CONTACT ASSEMBLY

This is a continuation of application Ser. No. 535,505, filed Sept. 26, 1983.

The invention relates to a contact assembly for a switching unit.

There is a requirement for a contact assembly for use in a rotary switching unit which is capable of reliably performing a very large number of switching cycles in an adverse environment subject to continual vibration and fluctuating fluid pressure which prevails, for example in a suspension unit of a vehicle. It is also necessary that such contact assembly be capable of economic manufacture and assembly using mass production techniques.

Many known rotary switching units include a stator block moulded in one piece of insulating material in which are mounted, stamped and formed terminals having circumferentially spaced contact portions adjacent a contact face of the block and wire connecting portions adjacent a rear face of the block. A rotor has included an insulating disc keyed to a drive shaft and carrying a circumferentially extending brush conductor having contact portions arranged to wipe around the contact face of the block for registration with the contact portions of the terminals in a predetermined rotational position of the rotor relative to the stator.

In prior contact assemblies, the wire-connecting portions have been formed as crimping ferrules for termination of leads. However, in view of the pressure required to effect crimping, it has been necessary to terminate the leads prior to mounting the terminals in the housing causing handling difficulties. In addition, mounting the terminals in the housing either as an interference fit or by using conventional locking lances results in a variation of axial disposition as a result of manufacturing tolerances, particularly of the moulded part, with the result that the contact portions may not be perfectly flush with the contact face. Although this may be acceptable in ordinary applications, a very high number of cycles requires much greater precision so that contact wear is minimized. Furthermore, a known method of mounting the insulating disc on the rotary operating shaft by a detent formed on the disc being locked in a keyway on the shaft has proved unreliable over a period of time permitting excessive play with consequential unreliability.

Additional assembly and wire management problems arise in view of the space restriction prevailing in a cylindrical housing of a suspension unit with continually moving parts and fluctuating fluid pressures.

According to the invention, there is provided a contact assembly for a rotary switching unit incorporating in a vehicle suspension unit, comprising a cylindrical stator block moulded in one piece from insulating, plastics material with a front contact face and a rear face, a pair of stamped and formed metal terminals having contact portions and having wire-connecting portions of the insulation displacement type, the terminals having been moulded in the block with the contact portions located in circumferentially spaced relation flush with the surface of the contact face and the wire-connecting portions protruding from the block at a location spaced axially rearwardly of the contact face, each wire-connecting portion being provided with a wire-connecting slot having a wire-receiving mouth extending away from the block; a rotor comprising an insulating plastics disc carrying a circumferentially extending brush conductor having resilient contact arms having contact portions arranged to wipe around the contact face of the block into and out from registration with the contact portions of the terminals.

Moulding the terminals in the stator block ensures that the contact portions are always precisely flush with the contact surface of the stator avoiding accelerated contact wear while the provision of wire connecting slots enables the wires to be terminated subsequent to moulding the terminals in the block facilitating handling and assembly.

Radially extending ribs may be formed on opposite sides of the wire-connecting portions for protection during handling and assembly and axially extending tool-receiving recesses formed in the stator block facilitate severing of web portions of the terminals after moulding in the block.

The problem of securely mounting the plastics rotor on the operating shaft is overcome by heat staking lands on the rotor in apertures in a metal support disc fixed to the shaft. The support disc is dished having an axially extending peripheral flange which engages the rotor disc throughout its entire periphery.

The contact assembly according to the invention can function reliably for as many as two hundred thousand cycles in spite of exposure to varying temperatures, fluid pressures and the considerable vibration associated with a motor vehicle.

An example of a contact assembly for a rotary switching unit incorporated in a vehicle suspension unit will now be described with reference to the accompanying drawings in which.

Figure 5:
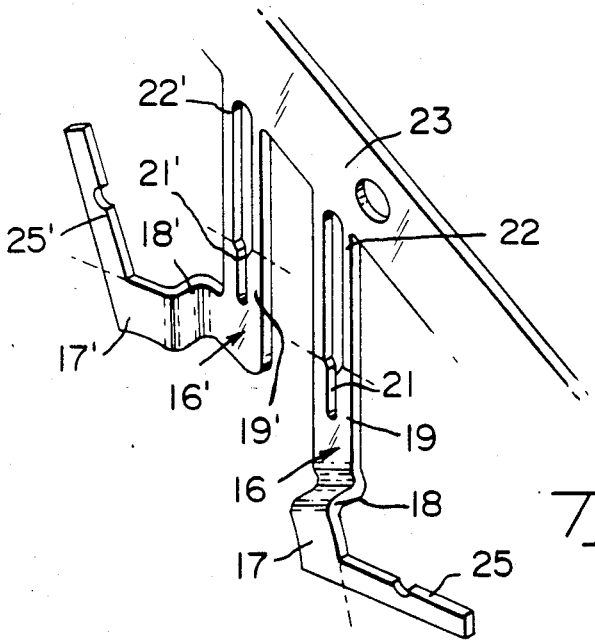
FIG. 5 is a perspective view of a pair of stator terminals mounted on a carrier strip prior to a moulding operation.
Figure 3:
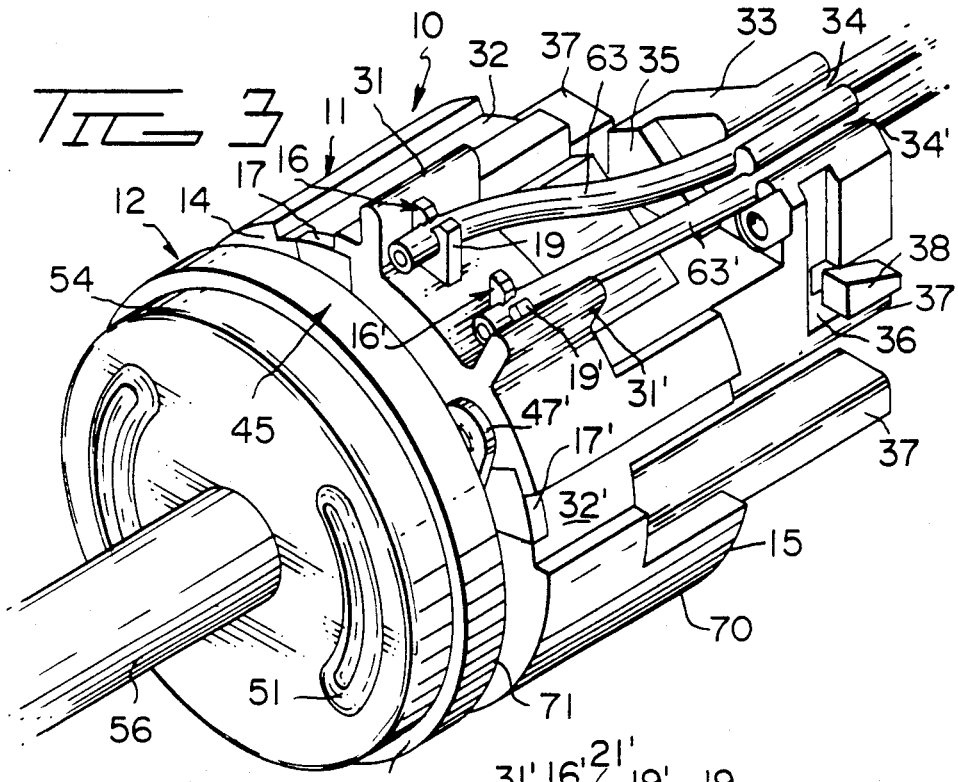
FIG. 3 is a perspective view of one side of the assembly.

The contact assembly comprises a stator 10 and a rotor 12 mounted for relative rotation in a fluid filled cylinder 13 of a vehicle suspension unit. Stator 10 comprises a cylindrical plastics block 11 formed at a front axial end with a smooth contact face 14 comprising a planar contact surface and, at the opposite end, with a rear face 15 and a peripheral side 70 therebetween. A pair of terminals 16, 16' respectively, are moulded in block 1. As shown particularly in FIG. 5, the terminals are stamped and formed from a single piece of sheet metal shock and have planar contact portions 17 and 17', respectively, connected by stepped body portions 18 and 18' to wire-connecting portions 19 and 19' of the insulation displacement type having wire-connecting slots 21 and 21'. Wire-connecting portions 19 and 19' are connected by webs 22 and 22' to a carrier strip 23 and contact portions 17 and 17' have locating arms 25 and 25' extending flag fashion from free ends thereof. Wire-connecting portions 19 and 19' and arms 25 and 25' assist in the accurate location of the terminals in the mould throughout the formation of stator block 11 after which moulding process they are severed along the broken lines indicated in FIG. 5.

Wire-connecting portions 19 and 19' extend radially from peripheral side 70 of block in side-by-side relation adjacent and axially spaced from contact face 14, and block 11 is formed with a pair of radially extending barrier ribs 31 and 31' on respective opposite sides of wire-connecting portions 19, 19' to protect the wire-connecting portions during handling. The circumferentially spaced contact portions 17 and 17' are flush with contact face 14 and axially extending recesses 32, 32' extend to each portion in alignment with locating arms 25, 25' for receipt of arm severing tooling. A land 33 is provided at rear face 15 and formed with undercut wire-receiving grooves 34, 34' aligned with wire-connecting portions 19, 19'. Block 11 is formed with adjacent transverse recesses 35 and 36 for the reception of anti-backlash springs (not shown) which form no part of the present invention.

Figure 4:
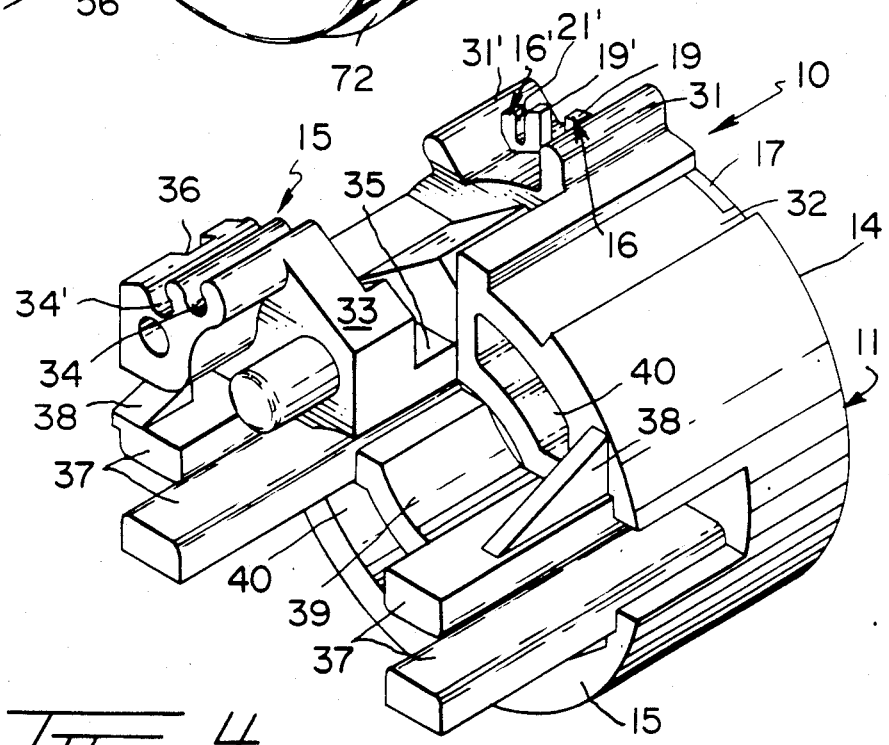
FIG. 4 is a perspective view of the other side of the stator.

Block 11 is formed with four axial mounting legs 37 extending from rear face 15 in circumferentially spaced relation, each leg 37 being reinforced by a strengthening gusset 38. A shaft-receiving bore 39 is formed axially in block 11 and cavities 40 (shown in FIG. 4) are formed on each side of block 11 in the interests of economy of material. Block 11 is formed with an orientation socket 41 in contact face 14 for receipt of an orientation pin during assembly.

Rotor 12 comprises a plastics disc 45 on a front contact face 71 of which is mounted a stamped and formed metal brush member 46. Brush member 46 has a pair of spaced resilient contact arms 47 and 47' joined by a circumferentially extending metal strip 48 fixed to front contact face 71 disc 45 by heat staking plastics projections 49 in apertures in the strip.

A rear face 72 of disc 45 is formed with circumferentially extending arcuate mounting lands 51 adapted to be heat staked in similarly shaped slots 52 in a metal support plate 53 with an axially extending peripheral support flange 54 of the plate in supporting engagement adjacent entire periphery of disc 45. The metal support plate 53 is fixed to a steadying shaft 56 and has a sleeve portion 56' sized for receipt in an axial aperture 57 in disc 45.

An orientation socket 58 is formed in disc 45 for registration with socket 41 to ensure accurate assembly of rotor 12 and stator 10 so that contact portions 64 on the free ends of resilient arms 47, 47' engage the respective contact portions 17, 17' of stator terminals 16, 16' in the datum position of the switching unit.

Figure 1:
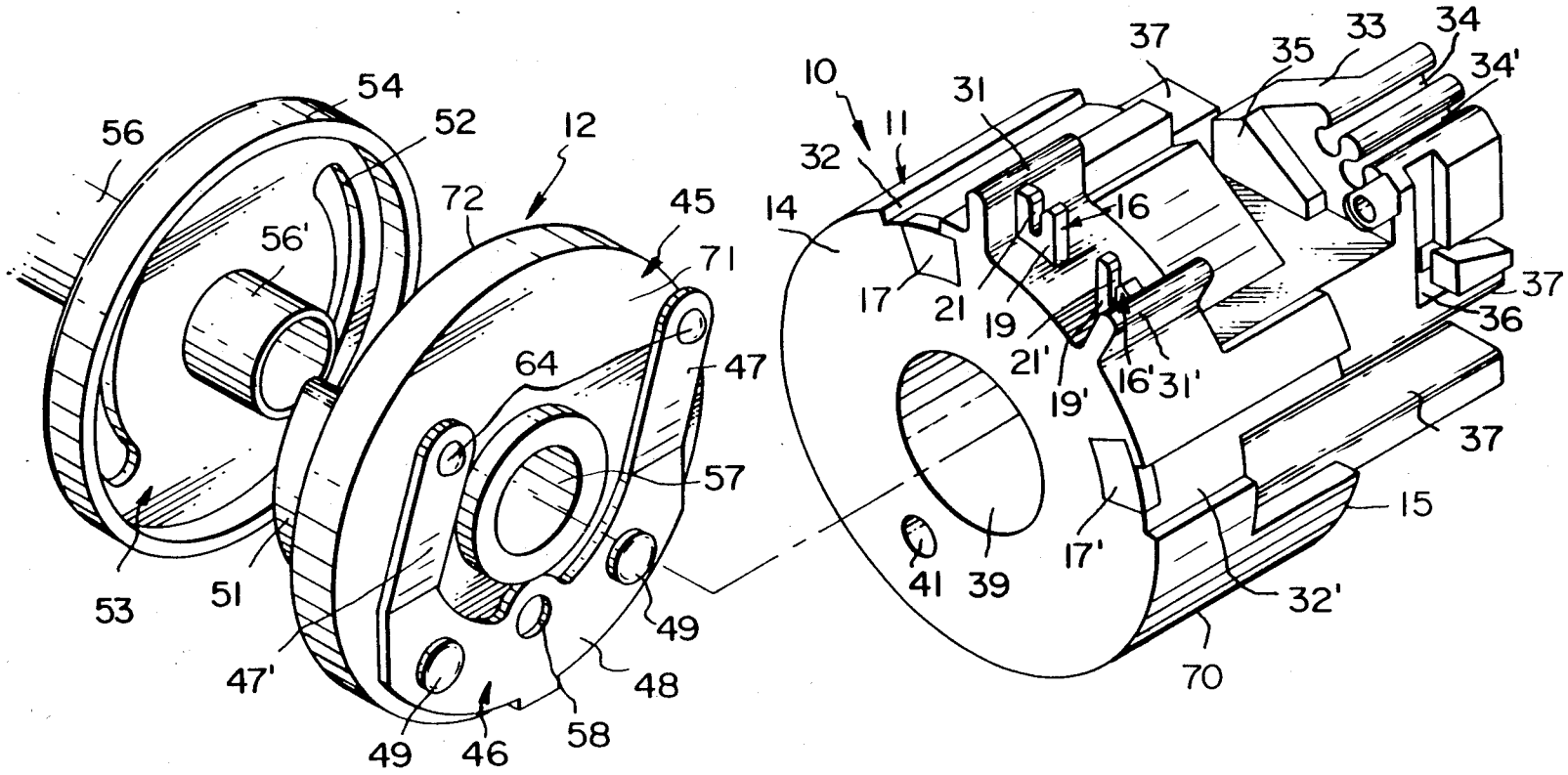
FIG. 1 is an exploded perspective view of the contact assembly.
Figure 2:
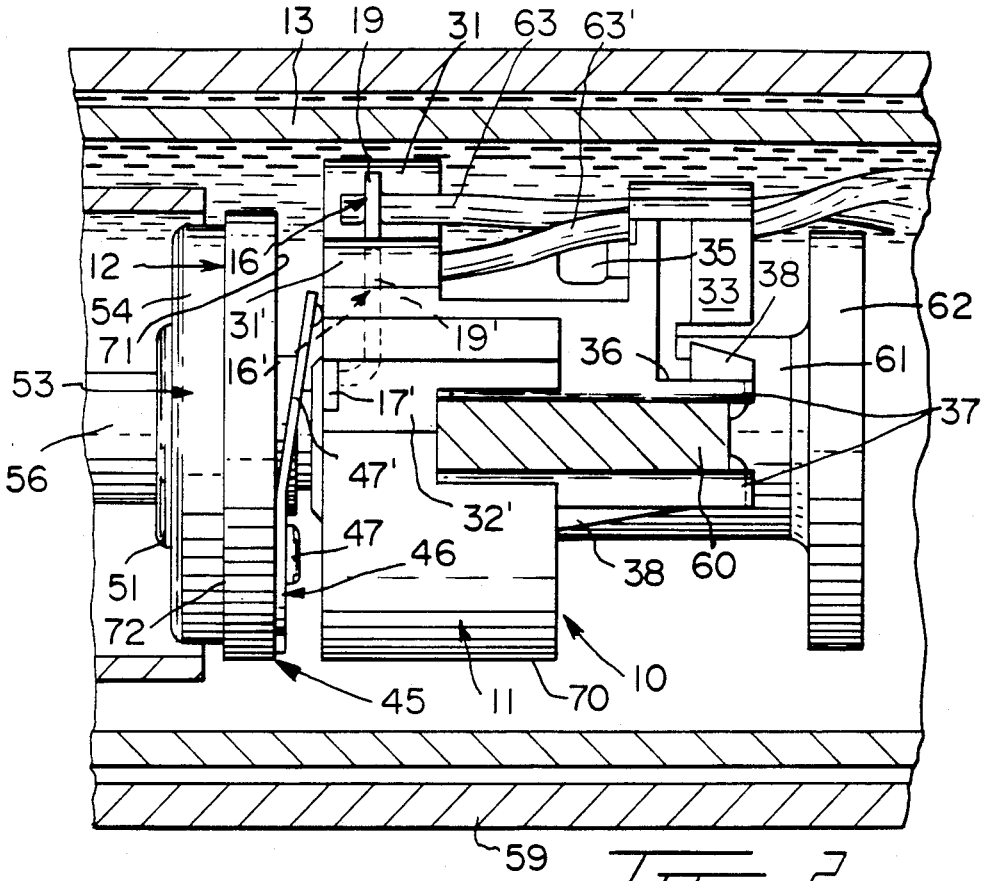
FIG. 2 is an elevation of the contact assembly incorporated in a vehicle suspension unit partly cut away for clarity.

After formation of tator 10 by the in-moulding operation described above and severance of carrier strip 23 and locating arms 25, 25', electrical leads 63, 63' are terminated simply by pressing into slots 21, 21' and wire confining grooves 34, 34' dressing the wire conveniently along peripheral side 70 of block 11 facilitating handling during subsequent assembly in cylinder 13 and providing strain relief. Stator block 11 is then fixed to a diametrically extending rib 60 in cylinder 13 by heat deforming free ends of legs 37 around rib 60 (as shown in FIG. 2) with a composite stepped drive shaft 61 extending from a ratchet member 62 freely through bore 39, keyed at a free end in shaft 56. Accurate relative angular location of rotor 12 (heat staked to support plate 53) and stator 10 is assured during assembly by extending a locating pin through the orientation apertures 41 and 58. The entire assembly is encased in tubing 59 filled with suspension fluid.

We claim:

1. A contact assembly for a rotary switching unit capable of being incorporated in a vehicle suspension unit, comprising a stator and a rotor securable in a datum position within a cylinder of said vehicle suspension unit, wherein:

said stator is in the form of a cylinder stator block moulded in one piece from insulating plastics material having a front contact face, a peripheral side and a rear face, a pair of stamped and formed metal terminals having contact portions and wire-connecting portions, the terminals having been moulded in the block with the contact portions located in circumferentially spaced relation flush with the surface of the contact face forming a planar contact surface and the wire-connecting portions protruding radially from the peripheral side of the block in side-by-side relation intermediate the front and rear faces, each wire-connecting portion being provided with a wire-connecting slot having a wire-receiving mouth extending away from the block;

said stator block is formed with a pair of protective ribs extending radially on respective opposite sides of and beyond the wire-connecting portions, and with axially extending tool-receiving recesses communicating with the front face to which recesses the contact portions radially extend, a rear section of the stator block being formed with adjacent wire-confining grooves aligned with the wire-connecting portions;

said stator block has mounting means for being coaxially mounted onto cooperating mounting means of said cylinder extending diametrically inwardly therefrom, said stator block having a substantial axial dimension such that said mounting means is securable to said cooperating mounting means at at least two axially spaced locations for stabilized mounting of said stator block within said cylinder, and said stator block has a bore extending axially therethrough to receive an operating shaft means of said switching unit freely rotatable therewithin; and said rotor comprises an insulating plastics disc carrying secured on a front face thereof a circumferentially extending brush conductor having resilient contact arms extending forwardly from said front rotor face toward said planar contact surface of said stator block, said contact arms having on free ends thereof brush contact portions arranged to wipe around said planar contact surface into and out from registration with the contact portions of the terminals with minimal contact wear, the rotor being integrally formed with circumferentially extending mounting lands fixed in apertures provided in a support disc fixed to said operating shaft means of the switching unit to secure the rotor on said shaft means, the support disc having an axially extending flange which engages the periphery of the rotor disc.

2. A contact assembly for a rotary switching unit capable of being incorporated into a vehicle suspension unit and of the type comprising a stator and a rotor securable in a datum position within a cylinder of said vehicle suspension unit, wherein:

said stator comprises a cylindrical stator block having a front contact face, a peripheral side and a rear face and being moulded in one piece from insulating plastics material and having secured therein a plurality of metal terminals each having a contact portion, a wire-connecting portion and a body portion therebetween;

said terminals have been moulded in the stator block with said contact portions located in circumferentially spaced relation flush with the surface of said front contact face forming a planar contact surface, and said wire-connecting portions protrude from said peripheral side of the stator block at a location spaced axially rearwardly of said planar contact surface to receive a wire for electrical connection thereto;

said stator block has mounting means for being coaxially mounted onto cooperating mounting means of said cylinder extending diametrically inwardly therefrom, said stator block having a substantial axial dimension such that said mounting means is securable to said cooperating mounting means at at least two axially spaced locations for stabilized mounting of said stator block within said cylinder, and said stator block has a bore extending axially therethrough to receive an operating shaft means of said switching unit freely rotatable therewithin;

said rotor comprises an insulating plastics disc having a front face spaced from said planar contact surface of said stator and carrying secured on said front face a circumferentially extending brush conductor having resilient contact arms extending forwardly from said front rotor face toward said planar contact surface, and contact arms having on free ends thereof brush contact portions arranged to wipe around said planar contact surface into and out from registration with the contact portions of the terminals with minimal contact wear; and said rotor has mounting means for being mounted securely onto said operating shaft means of said switching unit extending axially therethrough.

3. A contact assembly as set forth in claim 2 wherein a rear section of said stator block is provided with a land formed with adjacent wire-confining grooves aligned with respective said wire-connecting portions of the terminals.

4. A contact assembly as set forth in claim 2 wherein said stator block is formed with a pair of protective ribs extending radially on respective opposite sides of and beyond said wire-connecting portions of the terminals.

5. A contact assembly as set forth in claim 2 wherein said terminals are moulded in said stator block.

6. A contact assembly as set forth in claim 5 wherein said terminals each have a locating arm extending from a free end of said contact portion, and said peripheral side of said stator block is formed with axially extending tool-receiving recesses communicating with said front contact face to which recesses said contact portions extend, to assist in severing said locating arms from said terminals prior to mounting in said cylinder.

7. A contact assembly as set forth in claim 2 wherein said rotor mounting means comprise integrally formed circumferentially extending mounting lands fixed in apertures provided in a support disc fixed to said operating shaft means of the switching unit to secure the rotor on said shaft means, said support disc having an axially extending flange which engages the periphery of the rotor disc.

8. A contact assembly as set forth in claim 2 wherein said stator mounting means comprise axial legs extending rearwardly from said rear face of said stator block in circumferentially spaced relation to receive respective ones of said rib means of said cylinder between respective leg pairs and be fixed thereto.

9. A contact assembly as set forth in claim 2 wherein said mounting means of said stator block includes axial slot means in communication with said rear face to receive said cooperating mounting means of said cylinder therealong by relative axial movement of said stator block during mounting thereof into said cylinder.

10. A stator for a rotary switching unit capable of being incorporated into a vehicle suspension unit and comprising an insulating means having secured therein a plurality of metal terminals each having a contact portion, a wire-connecting portion and a body portion therebetween, said contact portions arranged along a contact face of said insulating means and said wire-connecting portions spaced rearwardly from said contact face, said contact face to be engaged by brush contact portions of a brush conductor on a forward surface of a rotor of said rotary switching unit fixed to an operating shaft means thereof, characterized in that:

said insulating means comprises one piece of insulating plastic which is moulded into a cylindrical block;

said contact portions of said terminals are flush with said contact face of said block forming a planar contact surface such that said brush contact portions of said rotor brush conductor are capable of wiping around said planar contact surface into and out from registration with said contact portions of said terminals with minimum contact wear;

said wire-connecting portions of said terminals extend from a peripheral side of said block spaced axially rearwardly from said planar contact surface to receive respective wires for electrical connection thereto; and said block has mounting means for being coaxially mounted onto cooperating mounting means of a cylinder of said vehicle suspension unit extending diametrically inwardly from said cylinder, said block having a substantial axial dimension such that said mounting means is securable to said cooperating mounting means at at least two axially spaced locations for stabilized mounting of said block within said cylinder, and said block has a bore extending axially therethrough to receive said operating shaft means of said switching unit freely rotatable therewithin.

11. A stator as set forth in claim 10 further characterized in that a rear section of said stator block is provided with a land formed with adjacent wire-confining grooves aligned with respective said wire-connecting portions of the terminals.

12. A stator as set forth in claim 10 further characterized in that said stator block is formed with a pair of protective ribs extending radially on respective opposite sides of and beyond said wire-connecting portions of the terminals.

13. A stator as set forth in claim 10 wherein said insulating means is moulded around said body portions of said terminals accurately located in a mould.

14. A stator as set forth in claim 13 further characterized in that said terminals each have a locating arm extending from a free end of said contact portion, and said peripheral side of said stator block is formed with axially extending tool-receiving recesses communicating with said contact face to which recesses said contact portions extend, to assist in severing said locating arms from said terminals prior to mounting in said cylinder.

15. A stator as set forth in claim 10 further characterized in that said stator mounting means comprises axial legs extending rearwardly from a rear face of said stator block in circumferentially spaced relation to receive respective ones of said rib means of said cylinder between respective leg pairs and be fixed thereto.

16. A stator as set forth in claim 2 wherein said mounting means includes axial slot means in communication with said rear face to receive said cooperating mounting means of said cylinder therealong by relative axial movement of said block during mounting thereof into said cylinder.

17. A rotor for a rotary switching unit capable of being incorporated into a vehicle suspension unit and comprising an insulating means having secured thereto a brush conductor having contact portions to wipe around a planar contact surface of a stator into and out from registration with contact portions of the stator terminals disposed on said planar contact surface, characterized in that:

said insulating means comprises an insulating plastics disc having a front face and mounting means for being mounted securely onto an operating shaft means of said switching unit extending axially therethrough; and said brush conductor is secured onto said front face and has resilient contact arms extending forwardly from said front face toward said planar contact surface, on free ends of which are said brush conductor contact portions.

18. A rotor as set forth in claim 17 further characterized in that said rotor mounting means comprise integrally formed circumferentially extending mounting lands fixed in apertures provided in a support disc fixed to said operating shaft means of the switching unit to secure the rotor on said shaft means, said support disc having an axially extending flange which engages the periphery of the rotor disc.

* * * * *

UNITED STATES PATENT AND TRADEMARK OFFICE

CERTIFICATE OF CORRECTION

PATENT NO. : 4,626,637

DATED : December 2, 1986

INVENTOR(S) : Billy E. Olsson et al.

It is certified that error appears in the above-identified patent and that said Letters Patent is hereby corrected as shown below:

Column 4, line 6, "cylinder" should read -- cylindrical --.

Signed and Sealed this

Seventeenth Day of February, 1987

*Attest:*

DONALD J. QUIGG

*Attesting Officer*

*Commissioner of Patents and Trademarks*